US011028747B2

(12) United States Patent
Nose et al.

(10) Patent No.: US 11,028,747 B2
(45) Date of Patent: Jun. 8, 2021

(54) CONTROLLER AND CONTROL METHOD FOR INTERNAL COMBUSTION ENGINE

(71) Applicant: TOYOTA JIDOSHA KABUSHIKI KAISHA, Toyota (JP)

(72) Inventors: Yuki Nose, Kasugai (JP); Yuto Ikeda, Toyota (JP); Hirofumi Hashinokuchi, Toyota (JP); Tatsuaki Suzuki, Okazaki (JP); Eiji Ikuta, Oobu (JP); Yoshiyuki Shogenji, Toyota (JP); Hirokazu Ando, Kariya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/526,920

(22) Filed: Jul. 30, 2019

(65) Prior Publication Data

US 2020/0049043 A1 Feb. 13, 2020

(30) Foreign Application Priority Data

Aug. 7, 2018 (JP) ..... JP2018-148058

(51) Int. Cl.
*F01N 3/025* (2006.01)
*F02D 41/30* (2006.01)
(Continued)

(52) U.S. Cl.
CPC ..... *F01N 3/0253* (2013.01); *F01N 3/101* (2013.01); *F01N 3/206* (2013.01); *F02D 37/02* (2013.01); *F02D 41/30* (2013.01)

(58) Field of Classification Search
CPC .. F01N 11/00; F01N 2240/16; F01N 2430/06; F01N 2430/085; F01N 2560/025; F01N 2560/026; F01N 2560/06; F01N 2610/02; F01N 2610/146; F01N 2900/0602; F01N 2900/1602; F01N 2900/1804; F01N 2900/1812; F01N 3/0253; F01N 3/0814; F01N 3/0842; F01N 3/0871; F01N 3/101; F01N 3/2013; F01N 3/2033; F01N 3/206; F01N 3/2066; F01N 3/208; F01N 3/22; F01N 3/30; F01N 9/00; F02D 37/02; F02D 41/042; F02D 41/123; F02D 41/1439;
(Continued)

(56) References Cited

U.S. PATENT DOCUMENTS 4,919,101 A * 4/1990 Noguchi ..... F02D 41/107 123/493
6,684,630 B2 * 2/2004 Uchida ..... F02D 41/405 60/284

(Continued)

*Primary Examiner* — Jesse S Bogue
(74) *Attorney, Agent, or Firm* — Oliff PLC

(57) ABSTRACT

A controller for an internal combustion engine includes a fuel introduction process of introducing an air-fuel mixture containing fuel injected by a fuel injection valve into an exhaust passage without burning the air-fuel mixture in a cylinder. The fuel introduction processor is configured to perform, during the execution of the fuel introduction process, a determination process of determining whether afterfire, in which the air-fuel mixture burns at an upstream side of a three-way catalyst device in the exhaust passage, has occurred and a stopping process of stopping the fuel introduction process when determining in the determination process that the afterfire has occurred.

10 Claims, 4 Drawing Sheets

(51) Int. Cl.
*F02D 37/02* (2006.01)
*F01N 3/20* (2006.01)
*F01N 3/10* (2006.01)

(58) Field of Classification Search
CPC ..... F02D 41/1441; F02D 41/1446; F02D 41/1454; F02D 41/146; F02D 41/2454; F02D 41/30; F02D 41/34
See application file for complete search history.

(56) References Cited

U.S. PATENT DOCUMENTS

| | | | | |
|---|---|---|---|---|
| 7,188,603 | B1 * | 3/2007 | Tsuji | F02D 41/126 123/326 |
| 8,406,980 | B2 * | 3/2013 | Nakagawa | F02D 41/2461 123/672 |
| 10,309,327 | B2 * | 6/2019 | Suzuki | F02P 9/002 |
| 2009/0308059 | A1 * | 12/2009 | Ikemoto | F01N 5/02 60/287 |
| 2014/0041362 | A1 * | 2/2014 | Ulrey | F02D 41/0087 60/274 |

* cited by examiner

CONTROLLER AND CONTROL METHOD FOR INTERNAL COMBUSTION ENGINE

BACKGROUND

1. Field

The following description relates to a controller and a control method for a spark-ignition internal combustion engine in which a three-way catalyst device is arranged in an exhaust passage.

2. Description of Related Art

A spark-ignition internal combustion engine performs combustion by igniting, with a spark of an ignition plug, the mixture of air and fuel introduced into a cylinder. The combustion of some of the fuel in the air-fuel mixture may be incomplete, thereby generating carbonaceous particulate matter (hereinafter referred to as PM).

U.S. Patent Application Publication No. 2014/0041362 discloses an onboard spark-ignition internal combustion engine including a three-way catalyst device arranged in an exhaust passage and a PM-capturing filter arranged at the downstream side of the three-way catalyst device in the exhaust passage. In such an internal combustion engine, PM generated in the cylinder is captured by a filter to restrict the PM from being released to the outside. The captured PM gradually deposits in the filter. Thus, if the deposition is left, the deposited PM may eventually clog the filter.

The internal combustion engine executes a fuel introduction process of increasing the temperature of the three-way catalyst device while the vehicle is coasting, thereby burning and removing the PM deposited in the filter. In the fuel introduction process, fuel injection is executed with the spark of the ignition plug stopped. This introduces the air-fuel mixture to the exhaust passage without burning the air-fuel mixture in the cylinder. The unburned air-fuel mixture introduced into the exhaust passage flows into the three-way catalyst device and burns in the three-way catalyst device. When the heat generated by the combustion increases the temperature of the three-way catalyst device, the temperature of the gas flowing out of the three-way catalyst into the filter increases. When the high-temperature heat increases the temperature of the filter to be higher than or equal to the ignition point of the PM, the PM deposited in the filter is burned and removed.

During the combustion operation of the internal combustion engine, an air-fuel ratio sensor arranged in the exhaust passage detects the air-fuel ratio of the air-fuel mixture burned in the cylinder, and an air-fuel ratio feedback control is executed to correct the fuel injection amount in accordance with the detection result of the air-fuel ratio. Then, the air-fuel ratio feedback control is performed to compensate for the deviation of the fuel injection amount of the fuel injection valve. In contrast, the air-fuel ratio feedback control cannot be performed through the fuel introduction process of stopping combustion in the cylinder. Thus, the amount of fuel actually injected by the fuel injection valve (actual injection amount) may deviate from the amount instructed by the controller (instructed injection amount). As a result, the actual injection amount is larger than the instructed injection amount, thereby increasing the fuel concentration of unburned air-fuel mixture introduced into the exhaust passage. This may cause afterfire, in which the air-fuel mixture burns in the exhaust passage before flowing into the three-way catalyst device. When afterfire occurs continuously, the surface of the catalyst is exposed to high-temperature heat, thereby deteriorating the three-way catalyst device. Additionally, the continuous occurrence of afterfire produces annoying combustion noise.

SUMMARY

A first aspect provides a controller configured to control an internal combustion engine. The internal combustion engine includes a fuel injection valve, a cylinder into which air-fuel mixture containing fuel injected by the fuel injection valve is introduced, an ignition device that ignites the air-fuel mixture introduced into the cylinder with a spark, an exhaust passage through which gas discharged out of the cylinder flows, and a three-way catalyst device arranged in the exhaust passage. The controller includes a fuel introduction processor configured to execute a fuel introduction process of introducing the air-fuel mixture, which contains the fuel injected by the fuel injection valve, into the exhaust passage without burning the air-fuel mixture in the cylinder. The fuel introduction processor is configured to perform a determination process of determining, during the execution of the fuel introduction process, whether afterfire, in which the air-fuel mixture burns at an upstream side of the three-way catalyst device in the exhaust passage, has occurred and a stopping process of stopping, during the execution of the fuel introduction process, the fuel introduction process when determining in the determination process that the afterfire has occurred.

In the controller for the internal combustion engine, when afterfire occurred during the execution of the fuel introduction process, the fuel introduction process is stopped at the point in time afterfire occurs. This stops introducing unburned air-fuel mixture into the exhaust passage. Thus, even if afterfire occurs during the fuel introduction process, continuation of the afterfire is limited.

During the execution of the fuel introduction process, unburned air-fuel mixture containing a large amount of oxygen flows into a section arranged at the upstream side of the three-way catalyst device in the exhaust passage. At this time, when afterfire occurs, the oxygen in the air-fuel mixture is consumed through the combustion. Thus, in a case in which the air-fuel ratio sensor is arranged at the upstream side of the three-way catalyst device in the exhaust passage, when afterfire occurs during the execution of the fuel introduction process, the air-fuel ratio detection value of the air-fuel ratio sensor is changed to the rich side. Accordingly, the determination process can be executed by determining that afterfire has occurred when the air-fuel ratio detection value of the air-fuel ratio sensor, which is arranged at the upstream side of the three-way catalyst device in the exhaust passage, is a value corresponding to a richer air-fuel ratio than a specified determination value.

Additionally, when afterfire occurs, the temperature of gas increases at a section where the afterfire occurs. Accordingly, the determination process can be executed by determining that afterfire has occurred when the temperature detection value of the exhaust temperature sensor, which is arranged at the upstream side of the three-way catalyst device in the exhaust passage, is greater than or equal to a specified determination value.

NOx, which is a product formed when air-fuel mixture is burned, is scarcely generated in a slow combustion in the three-way catalyst device during the fuel feeding process. In contrast, a large amount of NOx is generated by an intense combustion of afterfire. Accordingly, the determination process can be executed by determining that afterfire has occurred when the NOx concentration detection value of the NOx sensor, which is arranged at the downstream side of the three-way catalyst device in the exhaust passage, is greater than or equal to a specified determination value.

When the actual injection amount of the fuel introduction process deviates so as to be larger than the instructed injection amount, the fuel concentration of the air-fuel mixture introduced into the exhaust passage during the fuel introduction process becomes high. Thus, afterfire is likely to occur. Such a deviation of the fuel injection amount is not eliminated even after the fuel introduction process is stopped. This may cause afterfire to recur when the fuel introduction process is further executed. When the fuel feeding process is stopped in accordance with the determination that afterfire has occurred, the fuel feeding processor restricts the fuel feeding processes from being further executed. This prevents the recurrence of afterfire. The recurrence of afterfire can also be prevented by reducing the fuel injection amount of the fuel injection valve when executing the fuel introduction process after determining by the fuel introduction processor in the determination process that afterfire has occurred.

During the fuel introduction process, afterfire is likely to occur when the actual injection amount of the fuel injection valve is deviated such that the actual injection amount is larger than the instructed injection amount. In some internal combustion engines, during the combustion operation, the air-fuel ratio feedback control of the fuel injection amount is performed, and the air-fuel ratio learning value is learned in accordance with the correction value of the fuel injection amount by the air-fuel ratio feedback control. In such a case, if a proper value is learned for the air-fuel ratio learning value, the actual injection amount of the fuel injection valve deviates from the instructed injection amount of the fuel injection valve. Thus, when afterfire occurs during the fuel introduction process, an improper value may be learned for the air-fuel ratio learning value. Accordingly, it is preferred that during the combustion operation of the internal combustion engine, the controller for the internal combustion engine performs the air-fuel ratio feedback control of the fuel injection amount based on the air-fuel ratio detection value of the air-fuel ratio sensor arranged at the upstream side of the three-way catalyst device in the exhaust passage. It is also preferred that when the internal combustion engine includes the air-fuel ratio control unit, which learns the air-fuel ratio learning value in accordance with the correction value of the fuel injection amount by the air-fuel ratio feedback control, the air-fuel ratio learning value be relearned when determining in the determination process that afterfire has occurred.

Additionally, the fuel introduction processor should simply be configured to record, as diagnosis information, a number of times the fuel introduction process has been stopped in accordance with the determination result of the determination process. In such a case, the information of the number of times of stopping the fuel introduction processor, which is recorded by the fuel introduction processor, can be used for a purpose of, for example, identifying where fault occurs during maintenance.

A second aspect provides a method for controlling an internal combustion engine. The internal combustion engine includes a fuel injection valve, a cylinder into which air-fuel mixture containing fuel injected by the fuel injection valve is introduced, an ignition device that ignites the air-fuel mixture introduced into the cylinder with a spark, an exhaust passage through which gas discharged out of the cylinder flows, and a three-way catalyst device arranged in the exhaust passage. The method includes executing a fuel introduction process of introducing the air-fuel mixture, which contains the fuel injected by the fuel injection valve, into the exhaust passage without burning the air-fuel mixture in the cylinder, determining, during the execution of the fuel introduction process by the fuel introduction processor, whether afterfire, in which the air-fuel mixture burns at an upstream side of the three-way catalyst device in the exhaust passage, has occurred, and stopping, during the execution of the fuel introduction process by the fuel introduction processor, the fuel introduction process when determining in the determination process that the afterfire has occurred.

A third aspect provides a controller configured to control an internal combustion engine. The internal combustion engine includes a fuel injection valve, a cylinder into which air-fuel mixture containing fuel injected by the fuel injection valve is introduced, an ignition device that ignites the air-fuel mixture introduced into the cylinder with a spark, an exhaust passage through which gas discharged out of the cylinder flows, and a three-way catalyst device arranged in the exhaust passage. The controller includes processing circuitry configured to execute a fuel introduction process of introducing the air-fuel mixture, which contains the fuel injected by the fuel injection valve, into the exhaust passage without burning the air-fuel mixture in the cylinder, a determination process of determining, during execution of the fuel introduction process by the fuel introduction processor, whether afterfire, in which the air-fuel mixture burns at an upstream side of the three-way catalyst device in the exhaust passage, has occurred, and a stopping process of stopping, during the execution of the fuel introduction process by the fuel introduction processor, the fuel introduction process when determining in the determination process that the afterfire has occurred.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

First Embodiment

A controller for an internal combustion engine according to a first embodiment will now be described in detail with reference to FIGS. 1 to 3.

Figure 1:
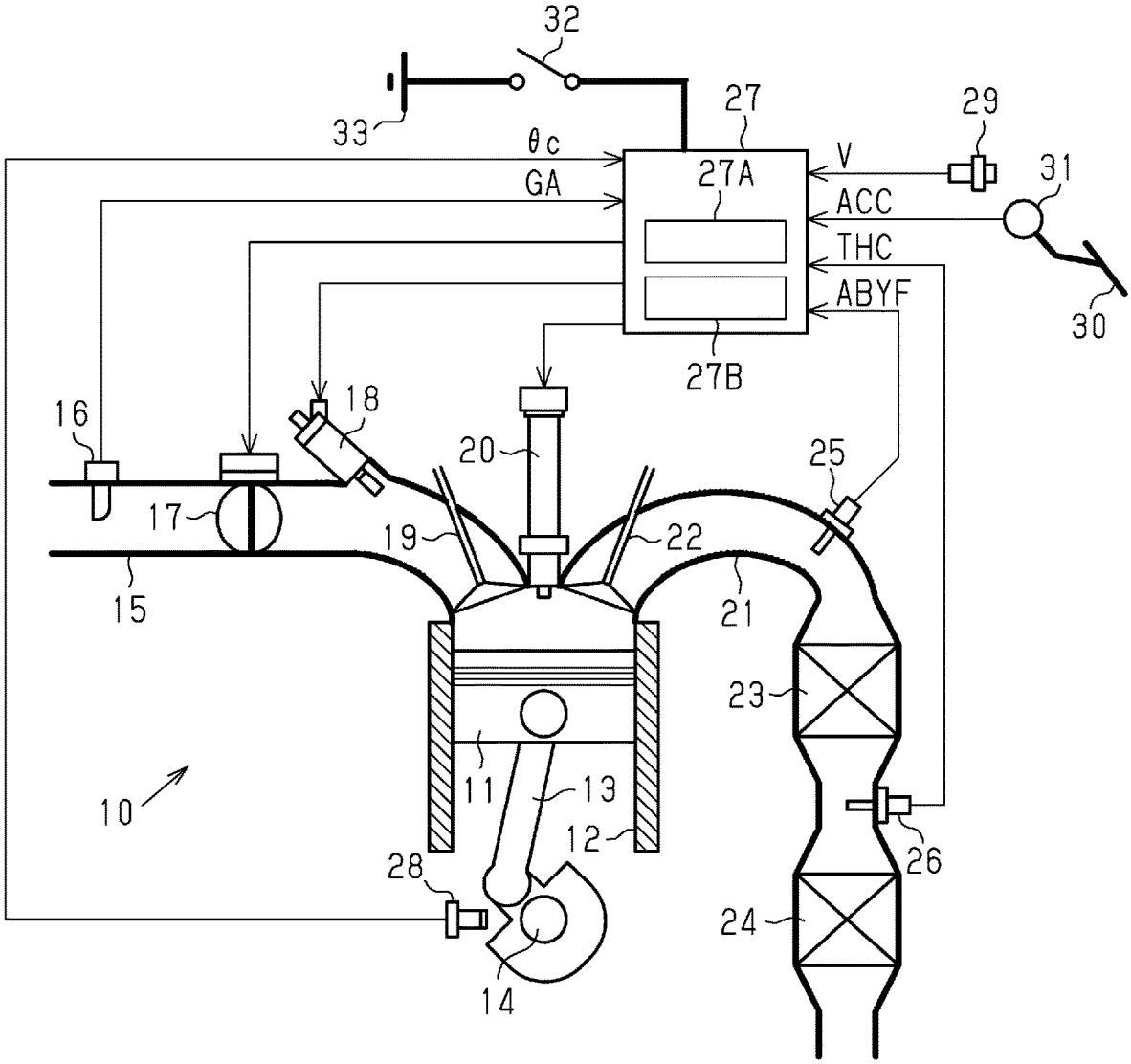
FIG. 1 is a schematic diagram showing the configuration of a controller for an internal combustion engine according to a first embodiment and a second embodiment.

As shown in FIG. 1, an internal combustion engine 10 mounted on a vehicle includes a cylinder 12, which accommodates a piston 11 such that the piston 11 can reciprocate. The piston 11 is coupled to a crankshaft 14 via a connecting rod 13. The reciprocating motion of the piston 11 in the cylinder 12 is converted into rotation of the crankshaft 14.

The cylinder 12 is connected to an intake passage 15, through which air is introduced into the cylinder 12. The intake passage 15 is provided with an airflow meter 16, which detects the flow rate of the air flowing through the intake passage 15 (intake air amount GA). A throttle valve 17 is provided at the downstream side of the airflow meter 16 in the intake passage 15. Further, a fuel injection valve 18 is provided at the downstream side of the throttle valve 17 in the intake passage 15. The fuel injection valve 18 injects fuel into the air flowing through intake passage 15 to form mixture of air and fuel.

The cylinder 12 has an intake valve 19, which connects and disconnects the intake passage 15 to and from the cylinder 12. Air-fuel mixture is introduced from the intake passage 15 to the cylinder 12 when the intake valve 19 opens. The cylinder 12 is provided with an ignition device 20, which ignites and burns the air-fuel mixture in the cylinder 12 with a spark.

The cylinder 12 is connected to an exhaust passage 21, which discharges exhaust gas generated by combustion of air-fuel mixture. The cylinder 12 has an exhaust valve 22, which connects and disconnects the exhaust passage 21 to and from the cylinder 12. The exhaust gas is introduced from the cylinder 12 into the exhaust passage 21 when the exhaust valve 22 opens. The exhaust passage 21 is provided with a three-way catalyst device 23, which oxidizes CO and HC in the exhaust gas and reduces NOx. Further, a filter 24 for trapping PM is provided in the exhaust passage 21 at the downstream side of the three-way catalyst device 23. An air-fuel ratio sensor 25 is arranged at the upstream side of the three-way catalyst device 23 in the exhaust passage 21 to detect the oxygen concentration of the gas flowing through the exhaust passage 21, that is, the air-fuel ratio (air-fuel ratio detection value ABYF) of the air-fuel mixture. Further, a catalyst outflow gas temperature sensor 26 is arranged between the three-way catalyst device 23 and the filter 24 in the exhaust passage 21 to detect a catalyst outflow gas temperature THC, which is the temperature of gas flowing out of the three-way catalyst device 23.

The engine 10 includes a controller 27. The controller 27 is configured as a microcomputer including a calculation processing circuit that executes calculation processes for control and a memory that stores programs and data for control. The controller 27 receives detection signals from the airflow meter 16, the air-fuel ratio sensor 25, and the catalyst outflow gas temperature sensor 26. Also, the controller 27 receives detection signals from a crank angle sensor 28, which detects a crank angle θc, or the rotational angle of the crankshaft 14. Furthermore, the controller 27 receives detection signals from a vehicle speed sensor 29, which detects a vehicle speed V, or the travelling speed of the vehicle, and an accelerator position sensor 31, which detects an accelerator operation amount ACC of an accelerator pedal 30. The controller 27 controls the opening degree of the throttle valve 17, the amount and timing of the fuel injection of the fuel injection valve 18, the timing of the spark of the ignition device 20 (ignition timing), and the like, thereby controlling the operating state of the internal combustion engine 10 in accordance with the driving situation of the vehicle. The controller 27 also calculates the rotational speed of the internal combustion engine 10 (engine rotational speed NE) from the detection result of the crank angle θc by the crank angle sensor 28.

The controller 27 is connected to an onboard power supply 33 via an ignition switch 32. When the ignition switch 32 is switched on (ignition is switched on), the onboard power supply 33 starts supplying power to the controller 27. When the ignition switch 32 is switched off (ignition is switched off), the onboard power supply 33 stops supplying power to the controller 27.

The controller 27 includes an air-fuel ratio control unit 27A, which performs an air-fuel ratio feedback control of the fuel injection amount based on the air-fuel ratio detection value ABYF of the air-fuel ratio sensor 25 during the combustion operation of the internal combustion engine 10. The air-fuel ratio control unit 27A uses the difference of the air-fuel ratio detection value ABYF from a target air-fuel ratio to control the air-fuel ratio of air-fuel mixture burned in the cylinder 12 by operating an air-fuel ratio feedback correction value FAF, which is one of the correction values of the fuel injection amount of the fuel injection valve 18, such that the difference approximates to zero. The air-fuel ratio control unit 27A learns an air-fuel ratio learning value KG, which is a correction value of the fuel injection amount, in accordance with the air-fuel ratio feedback correction value FAF. The air-fuel ratio control unit 27A learns the air-fuel ratio learning value KG by gradually updating the air-fuel ratio learning value KG such that the air-fuel ratio feedback correction value FAF approximates to zero. When the air-fuel ratio feedback correction value FAF stably remains around zero, the air-fuel ratio control unit 27A completes the learning of the air-fuel ratio learning value KG to stop updating the air-fuel ratio learning value KG. When, for example, the air-fuel ratio feedback correction value FAF normally deviates from zero after completion of learning, the air-fuel ratio control unit 27A relearns the air-fuel ratio learning value KG. Whether the learning of the air-fuel ratio learning value KG has been completed is indicated by the state of an air-fuel ratio learning flag. That is, the air-fuel ratio control unit 27A learns the air-fuel ratio learning value KG (updates the value) as described above when the air-fuel ratio learning flag is cleared. After completion of the learning of the air-fuel ratio learning value KG, the air-fuel ratio control unit 27A sets the air-fuel ratio learning flag.

The controller 27 further includes a fuel introduction processor 27B, which executes a fuel introduction process of introducing air-fuel mixture containing fuel injected by the fuel injection valve 18 without burning the air-fuel mixture in the cylinder 12. In the present embodiment, the fuel introduction processor 27B starts the fuel introduction process when the following conditions (1) to (3) are all satisfied.

(1) The combustion operation of the internal combustion engine 10 can be stopped. The fuel introduction process needs to be performed with the combustion in the cylinder 12 stopped and rotation of the crankshaft 14 kept. The controller 27 executes a deceleration fuel cut-off to stop the fuel injection of the fuel injection valve 18 of the internal combustion engine 10 and stops the spark of the ignition device 20 while the vehicle is coasting. It is determined that the combustion operation of the internal combustion engine 10 can be stopped when the condition of executing the deceleration fuel cut-off is satisfied. In the present embodiment, when the accelerator operation amount ACC is zero and the vehicle speed V is greater than or equal to a fixed value, it is determined that the vehicle is coasting. After the deceleration fuel cut-off is started, when the accelerator pedal 30 is depressed to request re-acceleration of the vehicle or when the vehicle speed V decreases to a specified return speed or lower, the controller 27 ends the deceleration fuel cut-off to resume the combustion operation of the internal combustion engine 10.

(2) Increasing the temperature of the three-way catalyst device 23 is requested. In the present embodiment, the fuel introduction process is executed in order to burn and remove PM deposited in the filter 24 by increasing the temperature of the three-way catalyst device 23. The controller 27 estimates the amount of PM deposited in the filter 24 from the operating state of the internal combustion engine 10 and requests an increase temperature of the three-way catalyst device 23 when the estimated amount exceeds a certain value.

(3) Burned gas has been scavenged from the exhaust passage 21. Immediately after combustion in the internal combustion engine 10 is stopped, burned gas remains in the exhaust passage 21. In the present embodiment, the fuel introduction process is started after the burned gas in the exhaust passage 21 is replaced with air. In the present embodiment, it is determined whether the burned gas has been scavenged when the deceleration fuel cut-off continues for a certain amount of time or longer.

Figure 2:
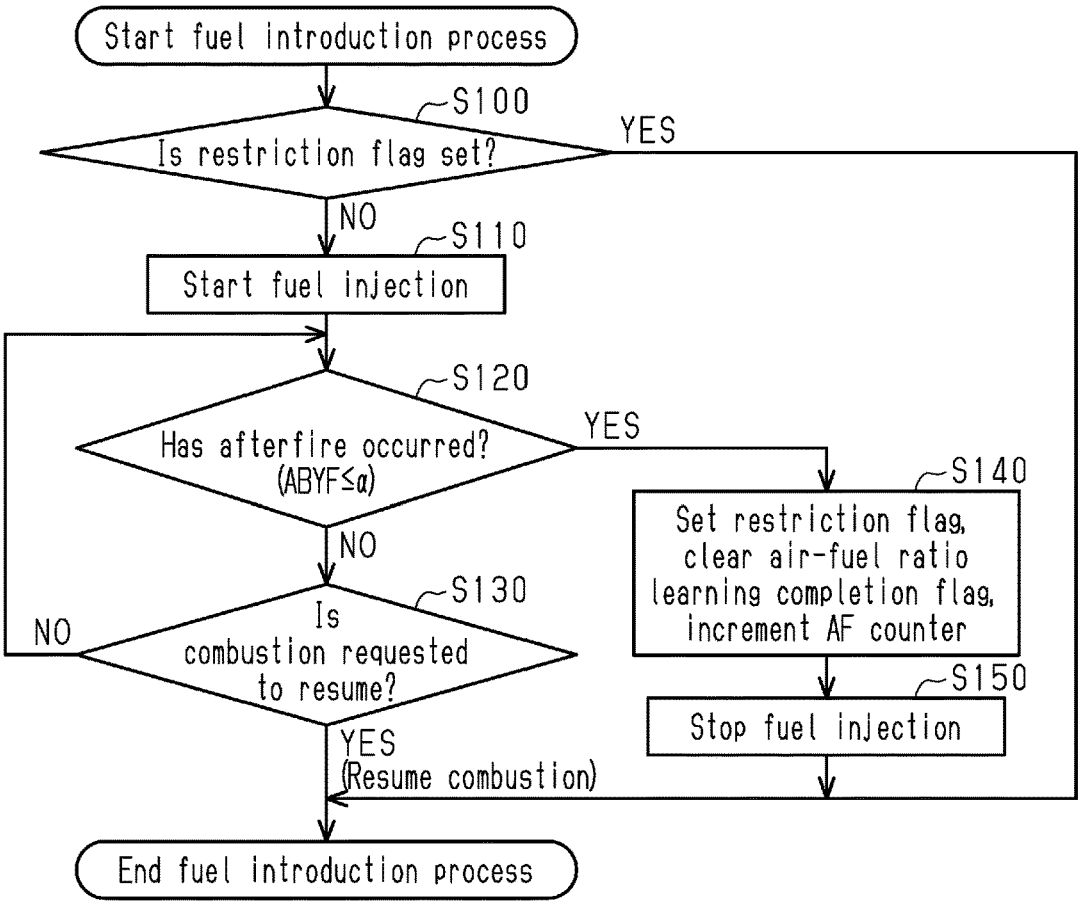
FIG. 2 is a flowchart showing a procedure executed by a fuel introduction processor from the beginning to the end of a fuel introduction process in the controller for the internal combustion engine according to the first embodiment.

FIG. 2 shows a procedure executed by the fuel introduction processor 27B from the beginning to the end of such a fuel introduction process. When the fuel introduction process is started, it is first determined in step S100 whether a restriction flag (described later) has been set. When the restriction flag has been set (S100: YES), the current fuel introduction process is ended.

When the restriction flag has not been set (S100: NO), the process is advanced to step S110. In step S110, the fuel injection of the fuel injection valve 18 is started. As described above, in the present embodiment, when the deceleration fuel cut-off is started and then burned gas in the exhaust passage 21 is scavenged, the fuel introduction process is started. At this time, the spark of the ignition device 20 is stopped. Thus, even if the fuel injection of the fuel injection valve 18 is started, combustion is not performed in the cylinder 12. Instead, air-fuel mixture containing fuel injected by the fuel injection valve 18 is introduced into the exhaust passage 21 without being burned in the cylinder 12. The unburned air-fuel mixture introduced into the exhaust passage 21 flows into the three-way catalyst device 23 and burns in the three-way catalyst device 23. This burning generates heat, thereby increasing the temperature of the three-way catalyst device 23. As the temperature of the three-way catalyst device 23 increases, the temperature of gas flowing out of the three-way catalyst device 23 and then into the filter 24 increases. When the heat of the flowing high-temperature gas increases the temperature of the filter 24 to the ignition point of the PM or higher, the PM deposited in the filter 24 is burned and removed.

The fuel introduction processor 27B controls the fuel injection amount of the fuel injection valve 18 in the following manner. That is, when controlling the fuel injection amount during the fuel introduction process, the fuel introduction processor 27B first determines a catalyst fuel supply amount, which is the amount of fuel supplied into the three-way catalyst device 23 per unit of time, based on the intake air amount GA. During the fuel introduction process, the three-way catalyst device 23 receives the heat generated through the combustion of fuel in the three-way catalyst device 23, and the heat is taken away from the three-way catalyst device 23 by gas passing through the three-way catalyst device 23. As the catalyst fuel supply amount increases, the amount of the received heat increases. As the flow rate of the gas passing through the three-way catalyst device 23 increases, the amount of the heat to be taken away increases. During the fuel introduction process, in which combustion is not performed in the cylinder 12, the flow rate of the gas passing through the three-way catalyst device 23 is approximately equal to the intake air amount GA. Thus, in the present embodiment, in order to increase the temperature of the three-way catalyst device 23 appropriately, the catalyst fuel supply amount is determined so as to be larger when the intake air amount GA is large than when the intake air amount GA is small. Subsequently, the fuel introduction processor 27B calculates a target injection amount, which is a target value of the fuel injection amount of the fuel injection valve 18 for each injection necessary for fuel pouring corresponding to the catalyst fuel supply amount, based on the catalyst fuel supply amount and the engine rotational speed NE. The fuel introduction processor 27B sets, as the fuel injection amount (instructed injection amount) set for the fuel injection valve 18, a value obtained by correcting the target injection amount with the air-fuel ratio learning value KG.

After starting the fuel injection in step S110, the fuel introduction processor 27B repeatedly executes a determination process of determining whether afterfire has occurred in step S120. Afterfire refers to a phenomenon in which unburned air-fuel mixture introduced into the exhaust passage 21 burns before flowing into the three-way catalyst device 23. Afterfire is likely to occur when the fuel concentration of unburned air-fuel mixture introduced into the exhaust passage 21 is high. In the present embodiment, it is determined whether afterfire has occurred based on the air-fuel ratio detection value ABYF of the air-fuel ratio sensor 25. More specifically, it is determined that afterfire has occurred when the air-fuel ratio detection value ABYF is a value corresponding to a richer air-fuel ratio than a specified rich determination value $\alpha$.

After starting fuel injection, in a case in which the determination that afterfire has occurred has never been made in the repetition of the determination process in step S120 and the combustion of the internal combustion engine 10 is requested to resume due to depression of the accelerator pedal 30 or a decrease in the vehicle speed V (S130: YES), the fuel introduction process ends at the point in time the request is issued. At the same time as when the fuel introduction process is ended, the combustion operation of the internal combustion engine 10 is resumed.

When it is determined that afterfire has occurred before combustion is requested to resume (S120: YES), the process is advanced to step S140. When the process is advanced to step S140, the restriction flag is set and an air-fuel ratio learning completion flag is cleared in step S140. Further, in step S140, the value of an AF counter, which indicates the number of times afterfire has occurred, is incremented. Subsequently, in step S150, the fuel injection is stopped and then the current fuel introduction process is ended. That is, when it is determined that afterfire has occurred during the execution of the fuel introduction process, the fuel introduction process is stopped at the point in time the determination is made. In this case, after the fuel introduction process is stopped, the combustion of the internal combustion engine 10 remains stopped until the combustion is requested to resume.

The state of the restriction flag is cleared when the ignition is turned off. The state of the air-fuel ratio learning completion flag and the value of the AF counter are kept even when the controller 27 stops supplying power after the ignition is turned off. The value of the AF counter indicates the number of times the fuel introduction process has been stopped in accordance with the occurrence of afterfire after a vehicle is shipped or after the controller 27 is initialized through repair or inspection. The information of the number of times of stopping is used for the purpose of, for example, identifying where fault occurs during maintenance.

The operation and advantages of the present embodiment will now be described.

Figure 3:
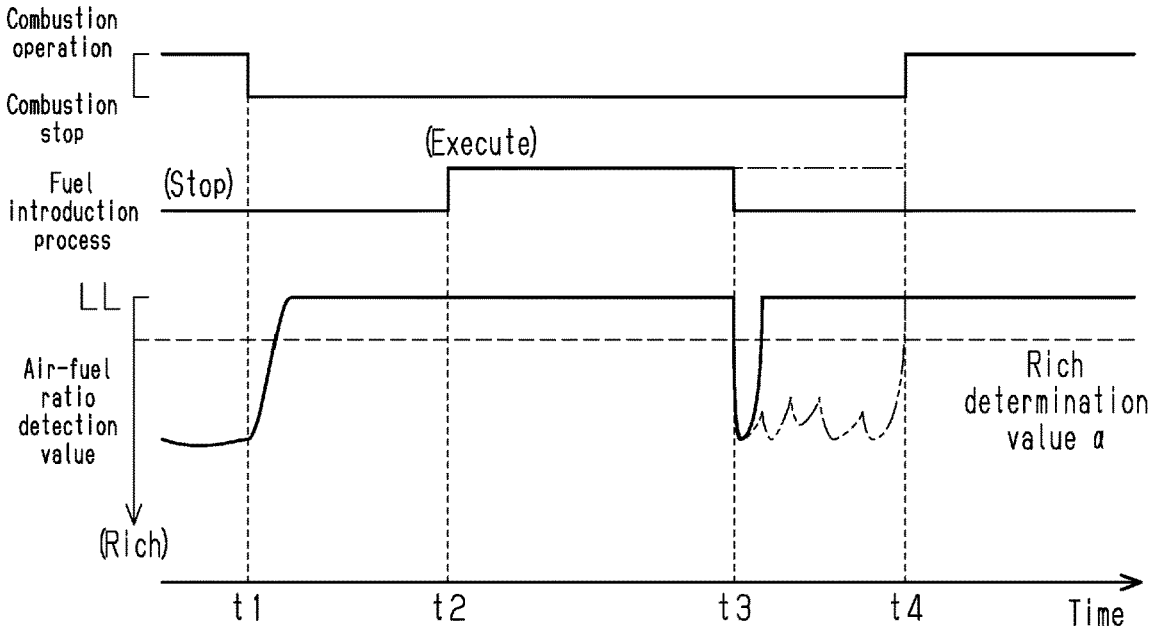
FIG. 3 is a time chart showing an example of how the fuel introduction process is performed.

FIG. 3 shows how the fuel introduction process is executed. In FIG. 3, the combustion of the internal combustion engine 10 begins stopping at time t1, and the fuel introduction process is started at time t2, which is subsequent to time t1. At time t4, the combustion of the internal combustion engine 10 is resumed. At time t3, when the fuel introduction process is started, afterfire occurs.

As shown by the long dashed double-short dashed line in FIG. 3, when the fuel introduction process is continued until the combustion is resumed, fuel continues to be introduced into the exhaust passage 21 even after the occurrence of afterfire. Thus, afterfire may continue until the fuel introduction process ends. As compared to a slow combustion reaction in the three-way catalyst device 23, afterfire is intense combustion. Thus, if afterfire continues, the surface of the catalyst may be exposed to high-temperature heat, thereby deteriorating the three-way catalyst device 23. Additionally, if afterfire continues, annoying combustion noises may be produced, thereby worsening the drivability.

During execution of the fuel introduction process, in which combustion is not performed in the cylinder 12, the oxygen concentration of gas discharged from the cylinder 12 to the exhaust passage 21 increases. During the period from when the fuel introduction process starts to when afterfire occurs (t2 to t3), gas having such a high oxygen concentration directly reaches a detector of the air-fuel ratio sensor 25. Thus, the air-fuel ratio detection value ABYF during this period indicates an air-fuel ratio considerably leaner than that during the combustion operation of the internal combustion engine 10. In FIG. 3, the air-fuel ratio detection value ABYF during this period remains at a lean limit value LL, which indicates an air-fuel ratio serving as the lean-side limit of an air-fuel ratio detection range of the air-fuel ratio sensor 25.

When afterfire occurs at time t3, the oxygen in the air-fuel mixture is consumed through combustion, thereby reducing the oxygen concentration of gas flowing around the detector of the air-fuel ratio sensor 25. Thus, the air-fuel ratio detection value ABYF changes from the lean limit value LL to a value corresponding to a rich air-fuel ratio. In this manner, the change amount of the air-fuel ratio detection value ABYF when afterfire does not occur is greatly different from that when afterfire occurs. In the present embodiment, a value that corresponds to a richer air-fuel ratio than the rich-side limit value in a possible range of the air-fuel ratio detection value ABYF when afterfire does not occur and corresponds to a leaner air-fuel ratio than the lean-side limit value in a possible range of the air-fuel ratio detection value ABYF when afterfire occurs is set as the rich determination value $\alpha$. When the air-fuel ratio detection value ABYF becomes a value that corresponds to a richer air-fuel ratio than the rich determination value $\alpha$, it is determined through the determination process that afterfire has occurred, thereby stopping the fuel introduction process. This stops introducing fuel into the exhaust passage 21 and thus stops afterfire.

In the present embodiment, during the execution of the fuel introduction process, when it is determined that afterfire has occurred in the determination process, the restriction flag is set. The restriction flag remains set until ignition is switched off. In a case in which the restriction flag is set when the fuel introduction process starts, no substantial process is performed and the fuel introduction process is ended. That is, when the fuel introduction process is stopped in accordance with the determination that afterfire has occurred, the fuel introduction processor 27B restricts the fuel introduction process from being further executed.

In some cases, even if the fuel introduction process is stopped in accordance with the occurrence of afterfire, the cause of afterfire is not identified. In such a case, afterfire is likely to recur when the fuel introduction process is further executed. In the present embodiment, when afterfire occurs during the fuel introduction process, further execution of the fuel introduction process is restricted until the ignition is turned off. This prevents the recurrence of afterfire.

When the fuel concentration of air-fuel mixture introduced into the exhaust passage 21 is high, afterfire is likely to occur. The fuel introduction processor 27B sets the catalyst fuel supply amount such that the fuel concentration of air-fuel mixture introduced into the exhaust passage 21 does not become high enough to produce afterfire. Thus, when afterfire occurs, the fuel injection amount of the fuel injection valve 18 may be deviated such that the actual injection amount is larger than the instructed injection amount. In the present embodiment, the fuel injection amount of the fuel injection valve 18 during the fuel introduction process is corrected by the air-fuel ratio learning value KG, which is learned during the combustion operation of the internal combustion engine 10. Thus, when afterfire occurs during the execution of the fuel introduction process, an improper value is highly likely to be learned as the value of the air-fuel ratio learning value KG. In the present embodiment, the fuel introduction processor 27B clears the air-fuel ratio learning completion flag when it is determined through the determination process that afterfire has occurred. The air-fuel ratio control unit 27A learns the air-fuel ratio learning value KG when the air-fuel ratio learning completion flag is cleared. That is, the air-fuel ratio control unit 27A relearns the air-fuel ratio learning value KG when it is determined through the determination process that afterfire has occurred. Accordingly, when afterfire has occurred during the execution of the fuel introduction process and an improper value is highly likely to be learned as the value of the air-fuel ratio learning value KG, the air-fuel ratio learning value KG is relearned.

Second Embodiment

An internal combustion engine according to a second embodiment of the present invention will now be described in detail with reference to FIG. 4.

In the first embodiment, when the fuel introduction process is stopped in accordance with the occurrence of afterfire, the fuel introduction processor 27B restricts the fuel introduction process from being further executed. In the present embodiment, the fuel introduction process is executed even after the fuel introduction process is stopped in accordance with the occurrence of afterfire. However, as described above, when afterfire has occurred, afterfire is likely to recur when the fuel introduction process is further executed. In the present embodiment, when the fuel introduction process is stopped in accordance with the occurrence of afterfire, the fuel injection amount of the fuel injection valve 18 is reduced when the fuel introduction process is further executed. This restricts the recurrence of afterfire.

Figure 4:
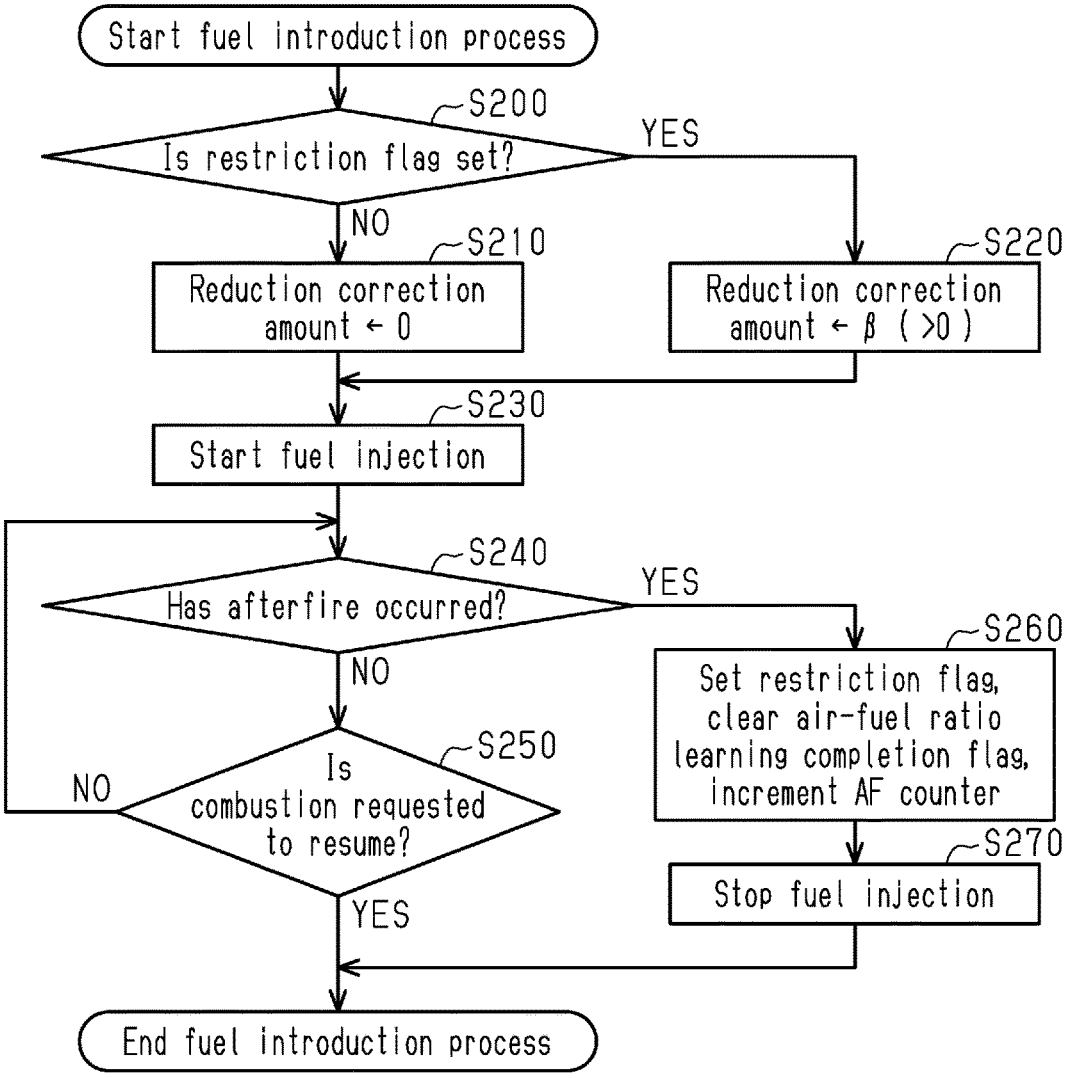
FIG. 4 is a flowchart showing a procedure executed by the fuel introduction processor from the beginning to the end of the fuel introduction process in the controller for the internal combustion engine according to the second embodiment.

FIG. 4 shows a procedure executed by the fuel introduction processor 27B from the beginning to the end of the fuel introduction process in the present embodiment. In the same manner as the first embodiment, the fuel introduction processor 27B starts the fuel introduction process when the conditions (1) to (3) are all satisfied in the second embodiment.

When the fuel introduction process is started, it is first determined in step S200 whether or not a reduction flag has been set. As described below, the reduction flag is set when it is determined that afterfire has occurred during the execution of the fuel introduction process. The state of the reduction flag is cleared when the ignition is turned off.

When the reduction flag is not set (S200: NO), 0 is set as the value of a reduction correction amount in step S210. Then, the process is advanced to step S230. When the reduction flag is set (S200: YES), a specified positive value β is set as the value of the reduction correction amount in step S220. Then, the process is advanced to step S230.

When the process is advanced to step S230, fuel injection is started in step S230. In the present embodiment, when performing the fuel injection, the fuel introduction processor 27B corrects, with the air-fuel ratio learning value KG, the target injection amount calculated from the catalyst fuel supply amount and the engine rotational speed NE. Further, the fuel introduction processor 27B sets, as the value of the instructed injection amount, the difference obtained by subtracting the reduction correction amount from the corrected value. As described above, 0 is set as the value of the reduction correction amount when the reduction flag is not set, and the positive value β is set as the value of the reduction correction amount when the reduction flag is set. Thus, the fuel injection amount of the fuel injection valve 18 during the fuel introduction process is smaller when the reduction flag is set than when the reduction flag is not set.

After starting the fuel injection, the fuel introduction processor 27B repeatedly executes the determination process of determining whether afterfire has occurred in step S240. In the same manner with the first embodiment, in the present embodiment, the determination process of determining whether afterfire has occurred is performed based on the air-fuel ratio detection value ABYF of the air-fuel ratio sensor 25.

After starting the fuel injection, in a case in which the determination that afterfire has occurred has never been made in the repetition of the determination process in step S240 and the combustion resumption of the internal combustion engine 10 is requested (S250: YES), the fuel introduction process ends at the point in time the request is issued. At the same time as when the fuel introduction process ends, the combustion operation of the internal combustion engine 10 is resumed.

When it is determined that afterfire has occurred before the combustion resumption is requested (S240: YES), the process is advanced to step S260. When the process is advanced to step S260, the reduction flag is set and the air-fuel ratio learning completion flag is cleared in step S260. Further, in step S260, the value of the AF counter is incremented. Subsequently, in step S270, the fuel injection is stopped and then the current fuel introduction process is ended. That is, when it is determined that afterfire has occurred during the execution of the fuel introduction process, the fuel introduction process is stopped.

When the fuel introduction process is executed again after the fuel introduction process is stopped, the reduction flag has already been set. Thus, the fuel introduction process is performed with a reduced fuel injection amount of the fuel injection valve 18. As described above, afterfire is likely to occur when the fuel injection amount of the fuel injection valve 18 is deviated such that the actual injection amount is larger than the instructed injection amount. Thus, reducing the fuel injection amount of the fuel injection valve 18 restricts the recurrence of afterfire.

Determination Process for Occurrence of Afterfire

In the above-described embodiments, the determination process of determining whether afterfire has occurred is performed based on the air-fuel ratio detection value ABYF of the air-fuel ratio sensor 25. Such a determination process does not have to be performed in this manner.

Figure 5:
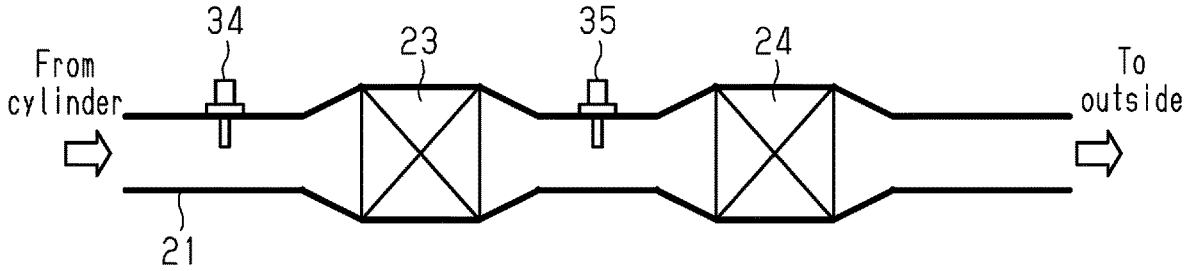
FIG. 5 is a schematic diagram showing the arrangement of sensors other than the air-fuel ratio sensor that can be used for a determination process.

FIG. 5 shows the arrangement of sensors other than the air-fuel ratio sensor 25 that can be used for the determination process. The determination process may be performed based on a temperature detection value of an exhaust temperature sensor 34, which is arranged at the upstream side of the three-way catalyst device 23 in the exhaust passage 21. Alternatively, the determination process may be performed based on a NOx concentration detection value of a NOx sensor 35, which is arranged at the downstream side of the three-way catalyst device 23 in the exhaust passage 21.

Figure 6:
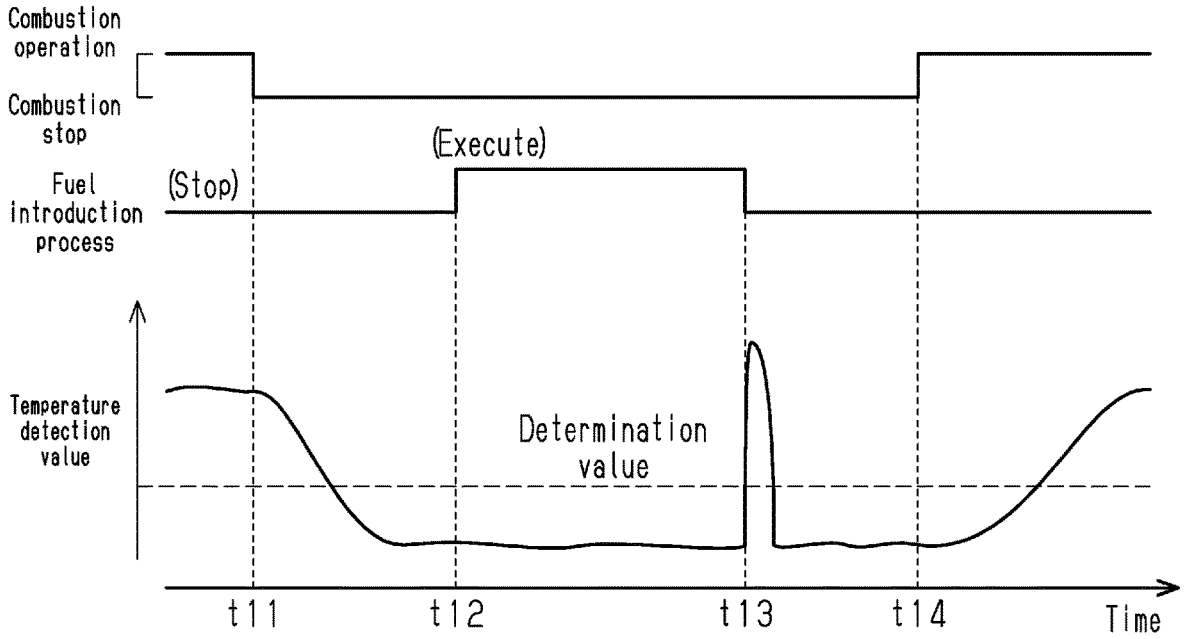
FIG. 6 is a time chart showing an example of how a catalyst temperature-increasing control is executed when it is determined whether afterfire has occurred based on a temperature detection value of the exhaust temperature sensor.

FIG. 6 shows how the fuel introduction process is executed when the determination process is performed based on the temperature detection value of the exhaust temperature sensor 34. In FIG. 6, the combustion of the internal combustion engine 10 begins stopping at time t11, and the fuel introduction process is started at time t12, which is subsequent to t11. At time t14, the combustion of the internal combustion engine 10 is resumed. At time t13, when the fuel introduction process is started, afterfire occurs.

When the combustion of the internal combustion engine 10 is stopped, the temperature of gas flowing through the exhaust passage 21 decreases. Thus, during the period from when the fuel introduction process starts to when afterfire occurs (t12 to t13), the temperature detection value of the exhaust temperature sensor 34 indicates a temperature lower than that during the combustion operation of the internal combustion engine 10. When afterfire occurs, the temperature of gas increases at a section where the afterfire occurs. Thus, when the temperature detection value of the exhaust temperature sensor 34 is greater than or equal to a specified determination value, it can be determined that afterfire has occurred. That is, there is deviation between a possible range of the temperature detection value when afterfire occurs and a possible range of the detection value when afterfire does not occur. Thus, the determination of whether afterfire has occurred can be made based on the temperature detection value by setting, as the determination value, a temperature higher than the maximum value of the possible range of the temperature detection value when afterfire does not occur and lower than the minimum value of the possible range of the temperature detection value when afterfire occurs. When the determination process is performed using the temperature detection value of the exhaust temperature sensor 34 in such a manner, afterfire is restricted from continuing by stopping the fuel introduction process in accordance with the occurrence of afterfire at time t13.

Figure 7:
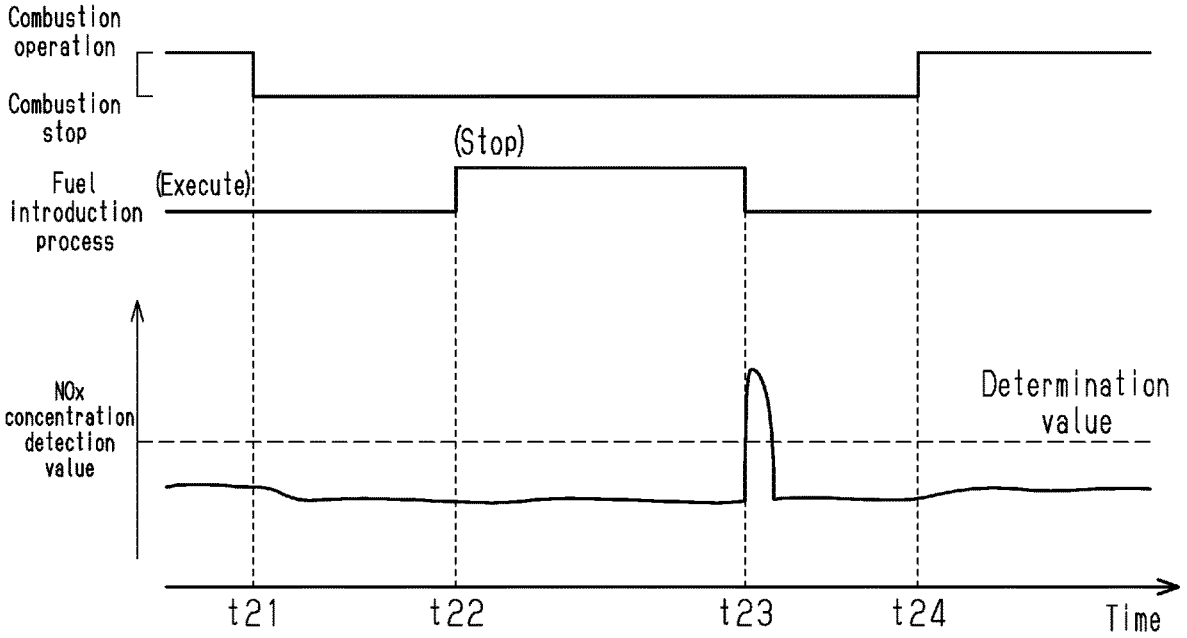
FIG. 7 is a time chart showing an example of how a catalyst temperature-increasing control is executed when it is determined whether afterfire has occurred based on a NOx concentration detection value of the NOx sensor.

FIG. 7 shows how the fuel introduction process is executed when the determination process is performed based on the NOx concentration detection value of the NOx sensor 35. In FIG. 7, the combustion of the internal combustion engine 10 begins stopping at time t21, and the fuel introduction process is started at time t22, which is subsequent to t21. At time t24, the combustion of the internal combustion engine 10 is resumed. At time t23, when the fuel introduction process is started, afterfire occurs.

NOx, which is a product formed when air-fuel mixture is burned, is scarcely generated in a slow combustion in the three-way catalyst device 23 during the fuel introduction process. In contrast, a large amount of NOx is generated through an intense combustion of afterfire. The combustion in afterfire is performed at an air-fuel ratio leaner than a stoichiometric air-fuel ratio. The gas flowing into the three-way catalyst device 23 through this combustion contains little reduction components of NOx. Thus, a large amount of NOx generated in afterfire directly passes through the three-way catalyst device 23 without being reduced in the three-way catalyst device 23, thereby increasing the NOx concentration detection value of the NOx sensor 35 with the occurrence of afterfire. Thus, when the NOx concentration detection value of the NOx sensor 35 is greater than or equal to a specified determination value, it can be determined that afterfire has occurred. That is, there is deviation between a possible range of the NOx concentration detection value when afterfire occurs and a possible range of the NOx concentration detection value when afterfire does not occur. Thus, the determination of whether afterfire has occurred can be made based on the NOx concentration detection value by setting, as the determination value, a concentration higher than the maximum value of the possible range of the NOx concentration detection value when afterfire does not occur and lower than the minimum value of the possible range of the NOx concentration detection value when afterfire occurs. When the determination process is performed using the NOx concentration detection value of the NOx sensor 35 in such a manner, afterfire is restricted from continuing by stopping the fuel introduction process in accordance with the occurrence of afterfire at time t23.

The above-described embodiments may be modified as follows. The above-described embodiments and the following modifications can be combined as long as the combined modifications remain technically consistent with each other.

In the above-described embodiments, when afterfire has occurred during the execution of the fuel introduction process, an improper value is likely to be learned as the air-fuel ratio learning value KG, that is, the air-fuel ratio learning value KG is likely to be learned incorrectly. In such a case, the air-fuel ratio learning value KG is then relearned. In some cases, for example, in a case in which the air-fuel ratio learning value KG is not learned or in a case in which the air-fuel ratio learning value KG is not reflected on the fuel injection amount during the fuel introduction process even if the learning is performed, the incorrect learning of the air-fuel ratio learning value KG is not a factor of the occurrence of afterfire during the execution of the fuel introduction process. Also, in some configurations of the internal combustion engine, factors other than the incorrect learning of the air-fuel ratio learning value KG cause afterfire during the execution of the fuel introduction process. In such a case, the air-fuel ratio learning value KG does not have to be relearned when the fuel introduction process is stopped in accordance with the occurrence of afterfire.

In the above-described embodiments, the fuel introduction processor 27B uses the AF counter to record, as diagnostic information, the number of times the fuel introduction process has been stopped in accordance with the determination result of the determination process. However, the number of times of such stopping does not have to be recorded.

In the above-described embodiments, unburned air-fuel mixture is introduced into the exhaust passage 21 by performing fuel injection with the spark of the ignition device 20 stopped. The timing at which the spark of the ignition device 20 can ignite the air-fuel mixture in the cylinder 12 is limited to a period close to the compression top dead center. That is, there is a period in which air-fuel mixture does not burn in the cylinder 12 even if the spark is generated. Thus, the fuel introduction of introducing unburned air-fuel mixture into the exhaust passage 21 can also be executed by performing fuel injection while generating the spark of the ignition device 20 during such a period.

In the above-described embodiments, the fuel introduction process is performed for the purpose of burning and removing PM deposited in the filter 24. Instead, the fuel introduction process may be performed to increase the temperature of the three-way catalyst device 23 for other purposes. For example, a catalyst temperature-increasing control may be performed to restore the exhaust purification performance of the three-way catalyst device 23 when the exhaust purification performance is reduced due to a decrease in the catalyst temperature.

In the above-described embodiments, the fuel introduction process is performed while the vehicle is coasting. However, the fuel introduction process may be performed under conditions other than coasting of the vehicle as long as the rotation of crankshaft 14 can be maintained with combustion in the internal combustion engine 10 stopped. Some hybrid vehicles having a motor as a drive source in addition to an internal combustion engine are capable of rotating the crankshaft with the driving force of the motor while the combustion operation of the internal combustion engine is stopped. In such hybrid vehicles, the fuel introduction process can be performed while rotating the crankshaft with the driving force of the motor.

In the above-described embodiments, the fuel introduction process is executed by injecting fuel into the intake passage 15 using the fuel injection valve 18. Alternatively, the fuel introduction process can be executed through fuel injection into the cylinders 12 in an internal combustion engine equipped with fuel injection valves of a direct injection type, which injects fuel into the cylinders 12.

The controller 27 is not limited to a device that includes a CPU and a memory and executes software processing. For example, at least part of the processes executed by the software in the above-described embodiments may be executed by hardware circuits dedicated to execution of these processes (such as ASIC). That is, the controller may be modified as long as it has any one of the following configurations (a) to (c). (a) A configuration including a processor that executes all of the above-described processes according to programs and a program storage device such as a ROM that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A controller configured to control an internal combustion engine, the internal combustion engine includes: (i) a fuel injection valve; (ii) a cylinder into which an air-fuel mixture containing fuel injected by the fuel injection valve is introduced; (iii) an ignition device that ignites the air-fuel mixture introduced into the cylinder with a spark; (iv) an exhaust passage through which gas discharged out of the cylinder flows; and (v) a three-way catalyst device arranged in the exhaust passage, the controller comprising:

a fuel introduction processor configured to execute:

a fuel introduction process of introducing the air-fuel mixture, which contains the fuel injected by the fuel injection valve, into the exhaust passage without burning the air-fuel mixture in the cylinder;

a determination process of determining, during the execution of the fuel introduction process, whether afterfire has occurred, in which the air-fuel mixture burns before flowing into the three-way catalyst device in the exhaust passage; and a stopping process of stopping, during the execution of the fuel introduction process, the fuel introduction process based on the determining in the determination process that the afterfire has occurred.

2. The controller according to claim 1, wherein the internal combustion engine includes an air-fuel ratio sensor arranged at the upstream side of the three-way catalyst device in the exhaust passage, and the determination process is performed by determining that the afterfire has occurred when an air-fuel ratio detection value of the air-fuel ratio sensor is a value corresponding to a richer air-fuel ratio than a specified determination value.

3. The controller according to claim 1, wherein the internal combustion engine includes an exhaust temperature sensor arranged at the upstream side of the three-way catalyst device in the exhaust passage, and the determination process is performed by determining that the afterfire has occurred when a temperature detection value of the exhaust temperature sensor is greater than or equal to a specified determination value.

4. The controller according to claim 1, wherein the internal combustion engine includes a NOx sensor arranged at a downstream side of the three-way catalyst device in the exhaust passage, and the determination process is performed by determining that the afterfire has occurred when a NOx concentration detection value of the NOx sensor is greater than or equal to a specified determination value.

5. The controller according to claim 1, wherein the fuel introduction processor is configured to restrict the fuel introduction process from being further executed until an ignition of the internal combustion engine is turned off, when stopping the fuel introduction process in accordance with determining that the afterfire has occurred.

6. The controller according to claim 1, wherein the fuel introduction processor is configured to reduce a fuel injection amount of the fuel injection valve when executing the fuel introduction process after determining in the determination process that the afterfire has occurred.

7. The controller according to claim 1, further comprising an air-fuel ratio control unit configured to:

perform, during a combustion operation of the internal combustion engine, an air-fuel ratio feedback control of a fuel injection amount based on an air-fuel ratio detection value of an air-fuel ratio sensor arranged at the upstream side of the three-way catalyst device in the exhaust passage;

learn an air-fuel ratio learning value in accordance with a correction value of the fuel injection amount by the air-fuel ratio feedback control; and relearn the air-fuel ratio learning value when determining in the determination process that the afterfire has occurred.

8. The controller according to claim 1, wherein the fuel introduction processor is configured to record, as diagnostic information, a number of times the fuel introduction process has been stopped in accordance with a determination result of the determination process.

9. A method for controlling an internal combustion engine, the internal combustion engine including: (i) a fuel injection valve; (ii) a cylinder into which an air-fuel mixture containing fuel injected by the fuel injection valve is introduced; (iii) an ignition device that ignites the air-fuel mixture introduced into the cylinder with a spark; (iv) an exhaust passage through which gas discharged out of the cylinder flows; and (v) a three-way catalyst device arranged in the exhaust passage, the method comprising:

executing a fuel introduction process of introducing the air-fuel mixture, which contains the fuel injected by the fuel injection valve, into the exhaust passage without burning the air-fuel mixture in the cylinder;

determining, during the execution of the fuel introduction process, whether afterfire has occurred, in which the air-fuel mixture burns before flowing into the three-way catalyst device in the exhaust passage; and stopping, during the execution of the fuel introduction process, the fuel introduction process based on the determining in the determination process that the afterfire has occurred.

10. A controller configured to control an internal combustion engine, the internal combustion engine including: (i) a fuel injection valve; (ii) a cylinder into which an air-fuel mixture containing fuel injected by the fuel injection valve is introduced; (iii) an ignition device that ignites the air-fuel mixture introduced into the cylinder with a spark; (iv) an exhaust passage through which gas discharged out of the cylinder flows; and (v) a three-way catalyst device arranged in the exhaust passage, the controller comprising processing circuitry configured to execute:

a fuel introduction process of introducing the air-fuel mixture, which contains the fuel injected by the fuel injection valve, into the exhaust passage without burning the air-fuel mixture in the cylinder;

a determination process of determining, during execution of the fuel introduction process, whether afterfire has occurred, in which the air-fuel mixture burns before flowing into the three-way catalyst device in the exhaust passage; and a stopping process of stopping, during the execution of the fuel introduction process, the fuel introduction process based on the determining in the determination process that the afterfire has occurred.

* * * * *